US007676895B2

(12) United States Patent
Cohen et al.

(10) Patent No.: US 7,676,895 B2
(45) Date of Patent: Mar. 16, 2010

(54) SHOE LACE END

(75) Inventors: Leon N Cohen, New York, NY (US); Jessica A Cohen, New York, NY (US); Gregory R Lucci, Venice, CA (US); Whitney Lucci, Venice, CA (US)

(73) Assignee: Ends Partners, LLC, New York, NY (US)

( * ) Notice: Subject to any disclaimer, the term of this patent is extended or adjusted under 35 U.S.C. 154(b) by 377 days.

(21) Appl. No.: 11/726,882

(22) Filed: Mar. 23, 2007

(65) Prior Publication Data

US 2008/0229563 A1 Sep. 25, 2008

(51) Int. Cl.
*A43C 9/06* (2006.01)

(52) U.S. Cl. ..... 24/715.4; 24/265 R

(58) Field of Classification Search ..... None
See application file for complete search history.

(56) References Cited

U.S. PATENT DOCUMENTS

| | | | | |
|---|---|---|---|---|
| 161,757 | A * | 4/1875 | Covert | 24/115 R |
| 341,146 | A | 5/1886 | Howes | |
| 899,888 | A * | 9/1908 | Munsell | 24/712.5 |
| 1,368,117 | A | 2/1921 | Claude | |
| 1,425,384 | A | 8/1922 | Kelly | |
| 1,810,602 | A | 6/1931 | Good | |
| 2,961,727 | A | 11/1960 | Coffey | 24/143 |
| 3,492,033 | A | 1/1970 | Mueller | |
| 3,636,594 | A | 1/1972 | Faivre | 24/73 |
| 3,734,054 | A | 5/1973 | Anderson | |
| 5,099,552 | A | 3/1992 | Kimbrough | 24/715.6 |
| 5,584,132 | A | 12/1996 | Weaver et al. | 36/136 |
| 5,638,589 | A | 6/1997 | Phillips | 24/715.4 |
| 2005/0055811 | A1 | 3/2005 | Cheng | |
| 2005/0132546 | A1 | 6/2005 | Cheng | 24/715.4 |
| 2006/0064856 | A1 | 3/2006 | Chen | 24/715.6 |
| 2006/0260153 | A1 | 11/2006 | White | 36/136 |

* cited by examiner

*Primary Examiner*—Jack W. Lavinder
(74) *Attorney, Agent, or Firm*—Ostrolenk Faber LLP

(57) ABSTRACT

An end piece for the end of a lace, string, filament or the like flexible article. The end piece includes a tube into which the end of the lace or the like is installed. A pin passes through and across the tube and pierces or traps the end of the flexible article in the tube. A decoration may be applied on the pin. A decoration support may be supported on the pin. The decoration support may have the form of a pivotable bridle attached on the ends of the pin. The bridle is supported to the tube by pintles. The pin passes through one pintle and into the other arm of the bridle.

18 Claims, 3 Drawing Sheets

SHOE LACE END

BACKGROUND OF THE INVENTION

The present invention relates to attaching an end covering piece to a free end of a string, lace, filament or other elongate flexible article. The end piece is useful, for example, for capping the end of the flexible article, decorating the end and/or attaching another object, such as a decoration or a support for a decoration on the end of the article. A particular non-limiting application of the invention is to cover the end of a shoelace, to serve as an aglet. The lace end piece attaches securely to the lace. It is also quickly and easily changed or replaced.

Laces, strings, filaments, and the like flexible articles have an end that may be covered, protected and decorated. There are numerous string, lace, filament and flexible article end coverings and decorations in the prior art. Many are used on the ends of shoe laces as aglets, but they are not so limited in their application. Examples of lace covers, lace end pieces and decorations are found in the prior art, including U.S. Pat. Nos. 1,425,384; 1,810,602; 2,961,727; 3,636,594; 5,584,132; and U.S. 2006/0064856.

Several disclosed lace end pieces include a cuff, cap or aglet that is fitted over the free end of the lace. These known lace end pieces or coverings are originally so shaped or are deformed after being fitted on the end of the lace so as to be securely held on the end of the lace. Examples of these include U.S. Pat. Nos. 5,584,132; and 5,638,589. These lace end pieces are held on the lace by their internal profiling or by shaping of the lace end piece. But, the end piece may not be fixed sufficiently on the lace to prevent the end piece being pulled free of the lace.

It is known to supply a lace end piece with ornamentation or decoration, as shown in U.S. Pat. No. 5,099,552; U.S. 2005/0132546; and U.S. 2006/0260153. Securement of the decoration to the lace end piece usually requires an extra securement device on the end piece.

SUMMARY OF THE INVENTION

The present invention is applicable to the end of a lace, string, filament or other elongate flexible article on which an end piece may be applied. Hereafter, an example of a lace end is described. But, it is to be understood that it applies to any elongate flexible article as well.

The present invention has the primary object of securely mechanically attaching an end piece to the end of a lace. In a simple form, the lace end piece of the invention comprises an end part in the form of a small diameter, preferably closed end tube into which the end of a lace is inserted. To prevent the inserted lace end from being easily removed from the end part or tube, a pin, or the like is passed through the tube walls and extends across the opening in the tube. The pin either pierces the end region of the lace in the tube or presses the end region of the lace against the interior of the tube and thereby mechanically traps the lace, to strongly resist separation of the lace end from the tube. The installed pin is anchored in the tube, e.g., by an end cap applied to the end of the pin that has been passed across the tube. The other end of the pin is sized so as to not pass into the tube.

The lace end piece that has been so attached to the free end of the lace may be of metal or other material, may be decorative in appearance or style, and may have any external form, so long as its interior is shaped and adapted to receive and hold the inserted end of the lace. The lace end piece attaches securely to the lace. It is also quickly and easily changed or replaced.

The inserted, lace end holding pin may also serve as a support for an additional decoration, such as a charm, precious metal chain and precious stones, and may serve as a support for a bridle, or the like piece. The pin and the bridle piece may in turn support and have attached to it any type of decoration.

Other features and advantages of the present invention will become apparent from the following description of the invention which refers to the accompanying drawings.

DETAILED DESCRIPTION OF EMBODIMENTS

Figure 3:
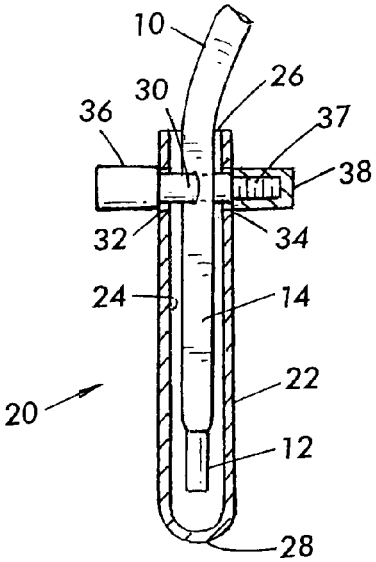
FIG. 3 is a cross-sectional view of the lace end piece of FIG. 1 showing the end of a lace captured inside the lace end piece.

A lace, string, filament, or the like elongate flexible article 10 is typically a flexible, thin length of a fabric or filamentary material which is used to secure, tie or tighten something. Lace 10 is illustrative of that. As seen in FIG. 3, the lace 10 has a free end 12 and an adjacent end region 14.

Figure 1:
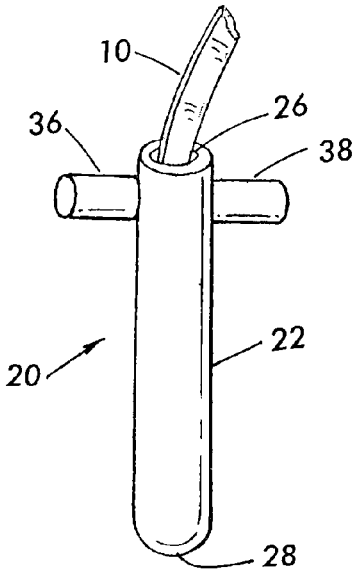
FIG. 1 is a side view of the lace end piece of a first embodiment of the invention.
Figure 2:
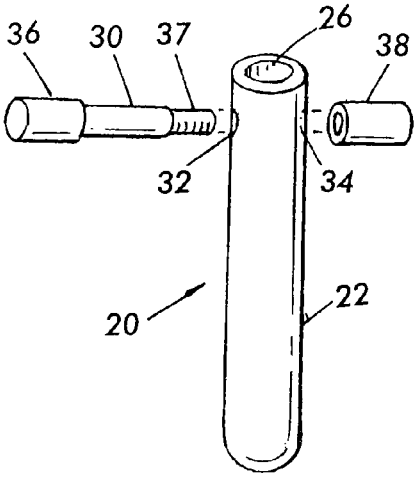
FIG. 2 shows the elements of the first end piece exploded apart.

The first embodiment of a lace end piece 20 in FIGS. 1-3 receives the end 12 and end region 14 of the lace 10 and the end piece is to be secured to the lace. The lace end piece 20 comprises an end part, e.g., in the form of a tube 22 with a tubular opening 24 along the axis of the tube. The opening in the tube is sized large enough to receive the lace end region 14 yet small enough to serve as an end piece on the lace. The end 12 and end region 14 of the lace 10 are inserted into the open end 26 of the opening 24. The other end 28 of the lace end piece 20 is preferably closed, because the lace end piece may be decorative and a closed end is more attractive and also because it strengthens the lace end piece 20 against deformation. But, the form of the end piece at the lace end 10 is a matter of choice.

The end region 14 of the lace 10 is secured by a pin 30 which is passed across the tube, through the openings 32 and 34 in opposite sides of the tubular body 22 of the end piece. Referring to FIG. 3, as the pin passes through the openings 32, 34, the pin 30 either pierces the end region 14 of the lace 10 or the pin is sufficiently large with reference to the shape and cross section of the tubular opening 24 that as the pin is passed across the tubular body 22, it effectively clamps the lace end region 14 against the interior wall 24 of the tube and secures the lace end in the tube 22. The pin 30 may have a flat end. Alternatively, and especially if is to pierce the end region 14 of the lace, the pin 30 may have a sharpened end. With the pin mounted in the tube 22, separation of the lace end piece 20 from the end 12, 14 of the lace is effectively prevented.

The pin 30 is held installed in the tube. There is a head 36 at one end of the pin, sized such that it cannot pass into the tube because it is blocked by the smaller size of the opening 32. The head is graspable to be rotated to install the other end region 37 of the pin in an end cap nut 38. The end cap 38 is an internally threaded nut, which is attached to the pin end region 37, for example, by a threaded connection between them. This prevents the pin from being extracted from the tube and thereby locks the lace end region 14 in the tube. Other types of connection of the pin 30 in the tube to prevent its unintended separation from the tube are possible, such as a friction fit. The end cap nut 38 is preferably attached to the exterior of the tubular body 22, e.g., by welding, or they are integrally formed together. The first embodiment of decorative lace end piece has thereby been attached to the lace 10.

Figure 4:
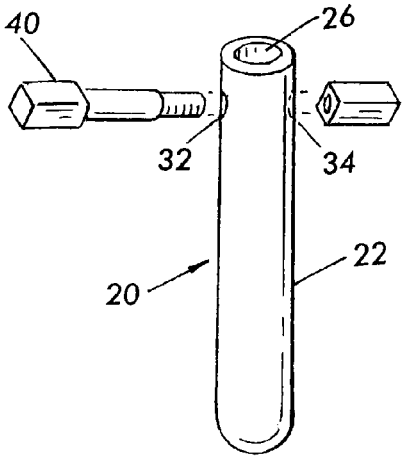
FIG. 4 shows a modified version of the first embodiment.

In the modified first embodiment in FIG. 4, the pin 40 is of square cross-section for easy gripping and turning and also for decorative reasons.

In addition the function performed by the pin may instead be performed by a friction between the pin end and the end cap, a colter pin, a safety pin or any other object that can pierce the lace end region or press it against the interior of the tube. Correspondingly, the end cap need not be a nut, but may be another object complementary to the pin to retain the pin.

Figure 5:
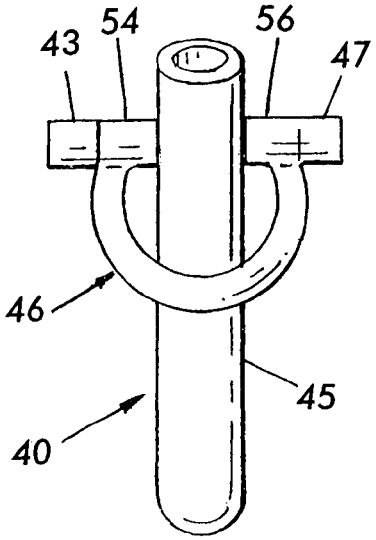
FIG. 5 is a side view of a second embodiment of a lace end piece of the invention.
Figure 6:
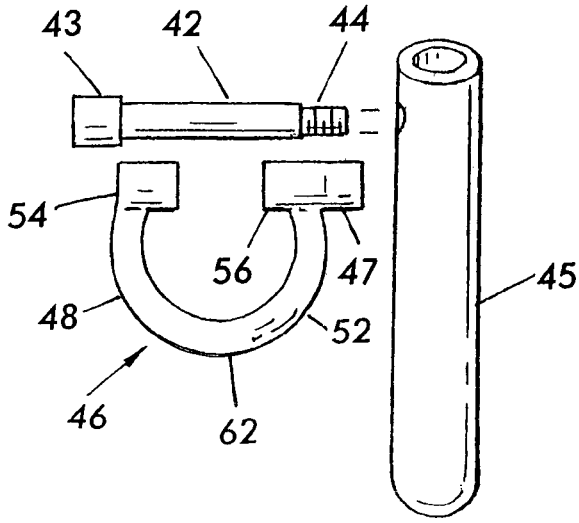
FIG. 6 shows the elements of the second embodiment exploded apart.
Figure 7:
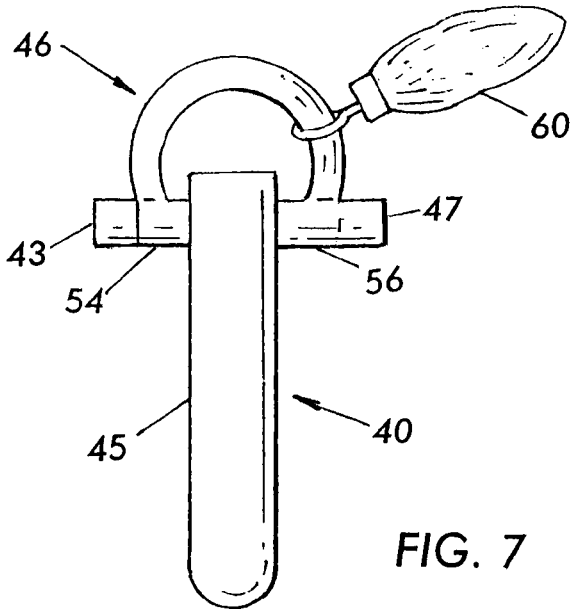
FIG. 7 shows a use of the second embodiment.

In a second embodiment 40 of a lace end piece according to the invention in FIGS. 5-7, there is a device for holding an additional decoration to the lace end piece 40. A pin 42 operates in the same way as the pin 30 of the first embodiment for holding the end 12, 14 of the lace 10 in the lace end piece 40. The pin 42 has a head 43 at one end and is threaded at 44 at the other end. The head 43 at one end of the pin 42 is held outside the tube 45 by a below described attachment 54 piece on a below described bridle 46. An attachment 56 is at the other end of the bridle and at the other side of the tube 45. Preferably, end attachments 54, 56 are non-removably attached to the tube, while the bridle is able to be swung over the open end 26 of the tube 45 so that the bridle may be disposed at either side of or above the open end of the tube.

Beyond the attachment 56 is an internally threaded nut 47 which receives the threaded end 44 of the pin 42. The nut 47 is preferably integrated with the attachment 56, whereby the attachment supports the nut 47 to receive the threaded end 44 of the pin. This prevents extraction of the pin 42 from the tube 44 and thereby holds the bridle 46.

The bridle 46 is a decoration. Alternatively, it has an additional function of supporting a decoration on the lace end piece 40. For example, the bridle 46 or other decorative support useful for supporting a decoration 60 is supported on the pin 42. In FIGS. 5-7, the bridle includes opposite legs 48, 52 which include the above mentioned respective attachments 54, 56 that are applied outside the tube 45 and inside the pin ends of pin 42 extending out of tube 45. The attachments on the bridle 46 are sleeves 54, 56 at the respective legs 48, 52. These sleeves allow the bridle to pivot around the pin 42, as suggested in FIG. 5 and 7. These sleeves may alternatively be or may act as a head on one end of the pin and an end cap on the other end of the pin, avoiding the parts 43 and 47.

The bridle includes a connecting web or body 62 which itself may be decorative or ornamental. Alternatively, the bridle can support an object 60 that is attached to it or alternatively an object may be applied to the bridle. An object 60 may be slipped onto the bridle 46 in its open condition of FIG. 6 before the bridle is installed on the pin 42. In this manner, the lace end 10 may be decorated however the user selects.

Figure 8:
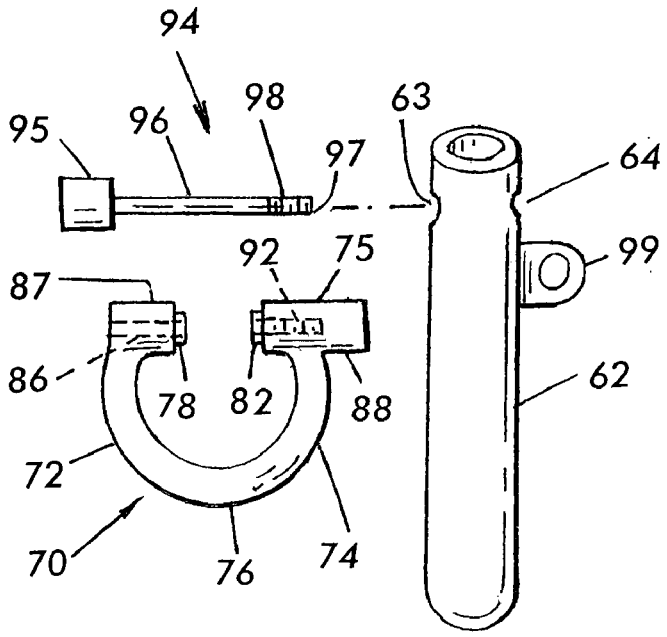
FIG. 8 is an exploded view of a third embodiment.
Figure 9:
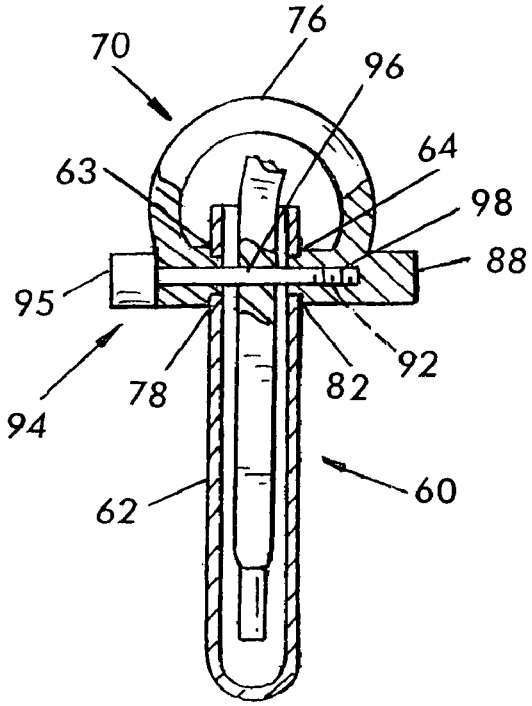
FIG. 9 is a cross sectional view thereof.

A further embodiment of a lace end piece 60 with bridle is illustrated in FIGS. 8 and 9. When fabricated, the lace end piece may have the same appearance as the second embodiment 40, or a different appearance as the designer selects. The difference lies in the construction of the bridle 70 and the manner in which the bridle is supported.

In this embodiment of lace end piece 60, there is a tube 62, which has aligned openings 63 and 64 at opposite sides, allowing passage of a pin 42 across the tube. The openings 63 and 64 are sized to support below described pintles 78, 82 on the bridle without the bridle or the pintles shifting radially, but to permit swinging of the bridle around the pintles. In other respects, the tube 62 is of the same construction as the tubes 22 and 45 of the two prior embodiments.

The bridle 70 has its two arms 72 and 74 joined by the web 76 between them. On the inward facing side of each of the arms 72 and 74, there is a respective tubular pintle 78 and 82. They have respective outside diameters approximating the diameters of the respective openings 63 and 64 in the tube. Initially, the bridle is formed with the arms 72 and 74 spread apart enough that the bridle pintles 78, 82 may be placed radially outward of the respective openings 63 and 64. Then a squeezing tool (not shown) squeezes the arms 72, 74 toward each other and moves the pintles 78 and 82 into the openings 63 and 64, thereby attaching the bridle 70 to the tube 62. The sizes of the pintles and holes are such that the bridle can be swung around the pintles 78 and 82 without the pintles shifting radially.

A small diameter hole 86 passes through the pintle 78 and the end region 87 of the arm from which the pintle projects. This hole receives the below described pin 94. At the end region 75 of the arm 74, outward of the pintle 82, is a pin end cover 88 which may also serve as a housing or a blind hole for the end region 98 of the pin. The cover 88 is affixed to the arm 74, e.g., by their being integrally formed or by the cover 88 being welded to the outside of the arm 74. The cover 88 has the same appearance as the head 95 of the below described pin 94 which passes across the tube 62 and gives the lace end piece 60 side to side symmetry at the bridle 70.

A hole 92 is formed in the pintle 82. The hole typically ends no deeper than the arm 74, but could also extend into the pin end cover 88. The interior of the hole 92 is threaded to receive end region 98 of the pin 94.

With the bridle 70 attached on the tube 60 as shown in FIG. 9, the pin 94 is inserted through the hole 86 into the hole 92. The pin 94 has a head 95 large enough to be grasped and rotated by a user to tighten the pin into the bridle. The head 95 may be decorative in shape. The pin end cover 88 is similarly shaped to the head 95. The shaft 96 of the pin 94 is small enough to pass through the pintle opening 86 and to be received in the pintle opening 92. The pin is also of a small enough diameter and/or is pointed so that its tip 97 will pierce through a typical cloth lace 10 at the end of which the lace end piece is disposed. The end region 98 of the pin shaft 96 is threaded correspondingly to the threaded opening 92 in the pintle 82, so that upon rotation of the pin 94 by its head 95, the threaded region 98 of the pin is tightened into the arm 74, thereby securing the pin at the bridle and securing the lace end 10 in the tube 62. The pin size and the diameters of the openings 86 and 92 are such that the inserted pin does not interfere with pivoting of the bridle.

The embodiment just described has the benefit of minimizing the number of separate parts for this lace end piece, making this embodiment easy to handle and easy to assemble into the final lace end piece. Other designs for connection of a bridle or object support to a tube of a lace end piece will be apparent to one skilled in the art.

All embodiments are themselves capable of numerous modifications for decoration, including changing the shape of the bridle, applying decorative stones or jewels (not shown)

on the bridle and/or on the tube or supplying a decoration support loop 99 on the tube 62 for supporting an additional decoration. Furthermore, stones or other decorations (not shown) may be placed on or in either end of the tube. The choices for decorating the lace end piece are limited only by the imagination of the manufacturer or the person using the lace end piece.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An end piece for attachment to a lace, string, filament or other elongate generally flexible article, the end piece comprising:

an end part in the form of a tube with an open end of the tube leading to an opening in the end part and the opening is sized to receive the end of the lace, string, filament or other elongate flexible article, the end part having a closed end opposite the open end;

a securement part extending across and through the end part of the end piece and the securement part is sized and shaped to either pierce or to clamp the flexible article or to prevent extraction of the flexible article from the end part.

2. An end piece for attachment to a lace, string, filament or other elongate generally flexible article, the lace end comprising:

an end part with an opening therein sized to receive the end of the lace, string, filament or other elongate flexible article;

a securement part comprising a pin extending across and through the end part of the end piece, the securement part pin is sized and shaped to either pierce or to clamp the flexible article or to prevent extraction of the flexible article from the end part, the pin has opposite ends; and blocking devices on the ends of the pin to prevent the pin from being drawn across and out of the end part.

3. The end piece of claim 2, wherein the blocking devices comprise an enlarged head at one end of the pin disposed outside the end part and an end cap at the other end of the pin and also disposed outside the end part.

4. The end piece of claim 3, wherein the other end of the pin is threaded and the end cap comprises an enlarged nut threaded on the threaded end of the pin.

5. The end piece of claim 2, further comprising holes in the end part positioned such that the pin can be passed through the holes to extend through and across the end part.

6. The end piece of claim 2, further comprising an additional device attached on the pin thereby to be supported on the end part.

7. The end piece of claim 2, further comprising an object support bridle attached on the pin and operative to support an object on the bridle.

8. The end piece of claim 7, wherein the pin has one end outward from the end part of the respective arm of the bridle and has another end with a threaded region, and a threaded receiving opening is at the end part of the other respective arm of the bridle and receives the threaded region of the pin.

9. An end piece for attachment to a lace, string, filament or other elongate generally flexible article, the lace end comprising:

an end part with an opening therein sized to receive the end of the lace, string, filament or other elongate flexible article;

a securement part comprising a pin extending across and through the end part of the end piece, the securement part pin is sized and shaped to either pierce or to clamp the flexible article or to prevent extraction of the flexible article from the end part, and an object support bridle attached on the pin and operative to support an object on the bridle, the bridle has a respective arm on the pin at attachments at each side of the end part.

10. The end piece of claim 9, wherein the bridle with its arms is generally U-shaped.

11. The end piece of claim 9, wherein the bridle is attached at the end part so that the bridle can be swung around its attachments at the end part.

12. The end piece of claim 11, wherein the pin has one end outward from the end part of one respective arm of the bridle and has another end with a threaded region;

a threaded receiving opening is at the end part of the other respective arm of the bridle and the threaded region of the pin is received in the receiving opening;

the tube has an open end that receives the flexible article and an opposite closed end; and the tube being of such length that with the bridle arms at the end part, the U-shaped bridle can be swung over the open end of the tube.

13. The lace end piece of claim 9, further comprising:

holes in the end part of the tube positioned such that the pin can be passed through the holes to extend through and across the end part; and a respective pintle on each of the arms of the bridle, each pintle being shaped and positioned on the arm of the bridle to be received in a respective one of the holes in the tube, such that with the pintles in the holes, the bridle may be swung around the pintles with respect to the tube.

14. The lace end piece of claim 13, further comprising a hole through one of the arms, and the respective first pintle at the one arm being shaped and sized to enable the pin to pass therethrough;

a respective pin end receiving hole in the other second pintle, such that the pin may be inserted through the first pintle and the pin has a free end received at the second pintle.

15. The lace end piece of claim 14, wherein the pin free end has a threaded portion, and the other arm with the second pintle has a threaded connection within it for receiving the threaded portion of the pin, such that the pin can be tightened into the threaded connection and thereby be secured in the lace end piece.

16. The lace end piece of claim 15, further comprising a head on the pin and the pin being of such length that with the pin installed in the pintle, the head is at the outside of the respective one arm of the bridle.

17. The lace end piece of claim 16, further comprising an external piece on the other bridle arm carrying the second pintle and located outward of the other arm from the second pintle and shaped for providing a simulation of the head of the pin at the one arm of the bridle.

18. The lace end piece of claim 17, wherein the external piece is integrated with the arm and is an extension of the respective pintle at the other arm.

* * * * *